US008571085B2

(12) United States Patent
Tenzek

(10) Patent No.: US 8,571,085 B2
(45) Date of Patent: Oct. 29, 2013

(54) INDUCTION FURNACE FOR THE CONTROLLABLE MELTING OF POWDER/GRANULAR MATERIALS

(75) Inventor: Anthony M. Tenzek, Hanoverton, OH (US)

(73) Assignee: Ajax Tocco Magnethermic Corporation, Warren, OH (US)

( * ) Notice: Subject to any disclaimer, the term of this patent is extended or adjusted under 35 U.S.C. 154(b) by 1435 days.

(21) Appl. No.: 12/215,165

(22) Filed: Jun. 25, 2008

(65) Prior Publication Data

US 2009/0323756 A1 Dec. 31, 2009

(51) Int. Cl.

| | |
|---|---|
| ***H05B 6/30*** | (2006.01) |
| ***H05B 6/02*** | (2006.01) |
| ***H05B 6/44*** | (2006.01) |
| ***F27D 3/00*** | (2006.01) |

(52) U.S. Cl.
USPC ..... 373/139; 373/138; 373/142; 373/144

(58) Field of Classification Search
USPC ..... 373/138, 139, 142, 144, 149, 151, 157, 373/7, 115, 6, 59, 140, 146; 219/634, 635, 219/638, 600, 672; 266/216, 175, 177, 234, 266/237; 117/18, 51; 432/86, 95–102, 122, 432/239
See application file for complete search history.

(56) References Cited

U.S. PATENT DOCUMENTS

| | | | | |
|---|---|---|---|---|
| 2,714,458 | A * | 8/1955 | Croft et al. | 414/187 |
| 3,252,601 | A * | 5/1966 | Isaacs | 414/201 |
| 3,445,247 | A * | 5/1969 | Baerwald | 426/640 |
| 5,108,461 | A | 4/1992 | Ruthner | |
| 5,232,521 | A * | 8/1993 | Takahashi et al. | 148/26 |
| 6,258,456 | B1 | 7/2001 | Meyer | |
| 2002/0085613 | A1 * | 7/2002 | Tsuda et al. | 373/142 |
| 2005/0259713 | A1 * | 11/2005 | Tenzek et al. | 373/151 |
| 2008/0156237 | A1 * | 7/2008 | Leihgeber | 110/258 |

* cited by examiner

*Primary Examiner* — Henry Yuen
*Assistant Examiner* — Hung D Nguyen
(74) *Attorney, Agent, or Firm* — Sand & Sebolt

(57) ABSTRACT

An induction furnace includes a melting induction coil for inductively heating a pair of susceptors for melting particulate material falling freely in a free fall zone between the susceptors. A feeder having a rotatable hollow shaft with fingers extending therefrom breaks up the material, which falls onto a vibrating dispersion plate and then into the free fall zone. A preheating induction coil inductively heats a susceptor which radiates heat to particulate material moving over the dispersion plate. An adjustable gap between the feeder and dispersion plate controls material flow. A funnel collects falling molten material and directs it through a nozzle into a mold. Induction coils control melting within the funnel. One induction coil heats the nozzle and may be controlled to allow the nozzle to cool sufficiently to form a solid plug in the nozzle whereby molten material pools above the plug.

24 Claims, 12 Drawing Sheets

INDUCTION FURNACE FOR THE CONTROLLABLE MELTING OF POWDER/GRANULAR MATERIALS

BACKGROUND OF THE INVENTION

1. Technical Field

The invention relates generally to inductive heating and inductive furnaces. More particularly, the invention relates to an induction furnace for melting particulate material. Specifically, the invention relates to an induction furnace for melting particulate material as the material is freely falling.

2. Background Information

The melting of granular material, powders and other particulate material presents several challenges. One of these challenges relates to the reluctance of particulate material to submerge into a molten bath of the same or similar material. A variety of factors are involved regarding this reluctance to submerge, including high surface tension of the molten bath as well as bulk density differences. Due to the tendency of particulate material to lie on the surface of the molten bath, the particulate material may be oxidized when the melting procedure takes place in an oxygen environment. In traditional induction furnaces, a meniscus is formed within the molten bath and the agitation or stirring within the molten bath helps to draw the particular material into the bath. However, the effectiveness of this agitation or stirring is marginally effective and the particulate material often remains atop the surface of the molten bath. This problem can be exacerbated if the feed rate of the particular material is too fast. In some cases, a dome of unmelted material known in the industry as a bridge may form atop the molten bath which can result in the superheating of the bath and potentially the melting of the containing crucible.

One partial solution to the problems associated with the addition of powders and other particulate material has been to form briquettes from the particulate material for use with induction, plasma or arc-type furnaces. One problem with the use of such briquettes is premature dissociation. In addition, some briquettes use binders which are a potential source of contamination in certain high purity materials and also give off gases which must be handled. The use of briquettes thus requires additional equipment, material handling and involves greater cost.

Another common problem with traditional melting methods is the use of particulate material which is coated with an oxide or the like. These oxides and the like create a buildup of a layer of slag on the surface of the molten bath. This slag layer also prevents additional particulate material from being absorbed into the molten bath.

There are other drawbacks related to traditional furnaces. Generally, such furnaces typically melt in batches as opposed to having the ability to provide a continuous melting process. In addition, many of these furnaces are physically large and must be mounted on floors or large platforms. The transfer of molten material from the furnace is typically done by a pour spout or an overflow method. Due to the weight of the crucibles and molten material, chain hoists or a hydraulically powered mechanism may be required to lift or tilt the crucible in order to pour the molten material out. In addition, these furnaces often pour the molten material into a secondary furnace or tundish. This may require the use of a launder as an intermediate structure involved in the transfer of the molten material. Thus, these and other types of furnaces require additional structural components which add to the cost of the process. Attempts to create a bottom pour mechanism have met with varying degrees of success and so the pouring of molten material remains an area for improvement.

BRIEF SUMMARY OF THE INVENTION

The present invention provides a furnace for use with particulate material, the furnace comprising a particle-feeding mechanism for feeding the particulate material; a free fall heating zone below and in communication with the particle-feeding mechanism; a free fall zone electromagnetic induction member; a first susceptor adjacent the free fall zone and inductively heatable by the induction member whereby the first susceptor is positioned to transfer heat to the particulate material when the material is freely falling in the free fall zone; and a thermal reflector bounding the free fall zone for reflecting heat radiated from the first susceptor.

The present invention also provides a furnace for use with particulate material, the furnace comprising a particle-feeding mechanism for feeding the particulate material; a dispersion member having an upper surface below the particle-feeding mechanism for receiving and dispersing the particulate material as it moves along the upper surface; a free fall heating zone below the dispersion member for receiving the particulate material therefrom; a free fall zone electromagnetic induction member; a first susceptor adjacent the free fall zone and inductively heatable by the induction member whereby the first susceptor is positioned to transfer heat to the particulate material when the material is freely failing in the free fall zone; a thermal reflector bounding the free fall zone for reflecting heat radiated from the first susceptor; wherein the free fall zone is between the first susceptor and thermal reflector; and a heated funneling member positioned below the free fall zone to receive the material from the free fall zone and configured to direct flow of the material in a molten state.

BRIEF DESCRIPTION OF THE SEVERAL VIEWS OF THE DRAWINGS

Preferred embodiments of the invention, illustrative of the best modes in which applicant contemplates applying the principles, are set forth in the following description and are shown in the drawings and are particularly and distinctly pointed out and set forth in the appended claims.

Similar numbers refer to similar parts throughout the specification.

DETAILED DESCRIPTION OF THE INVENTION

Figure 1:
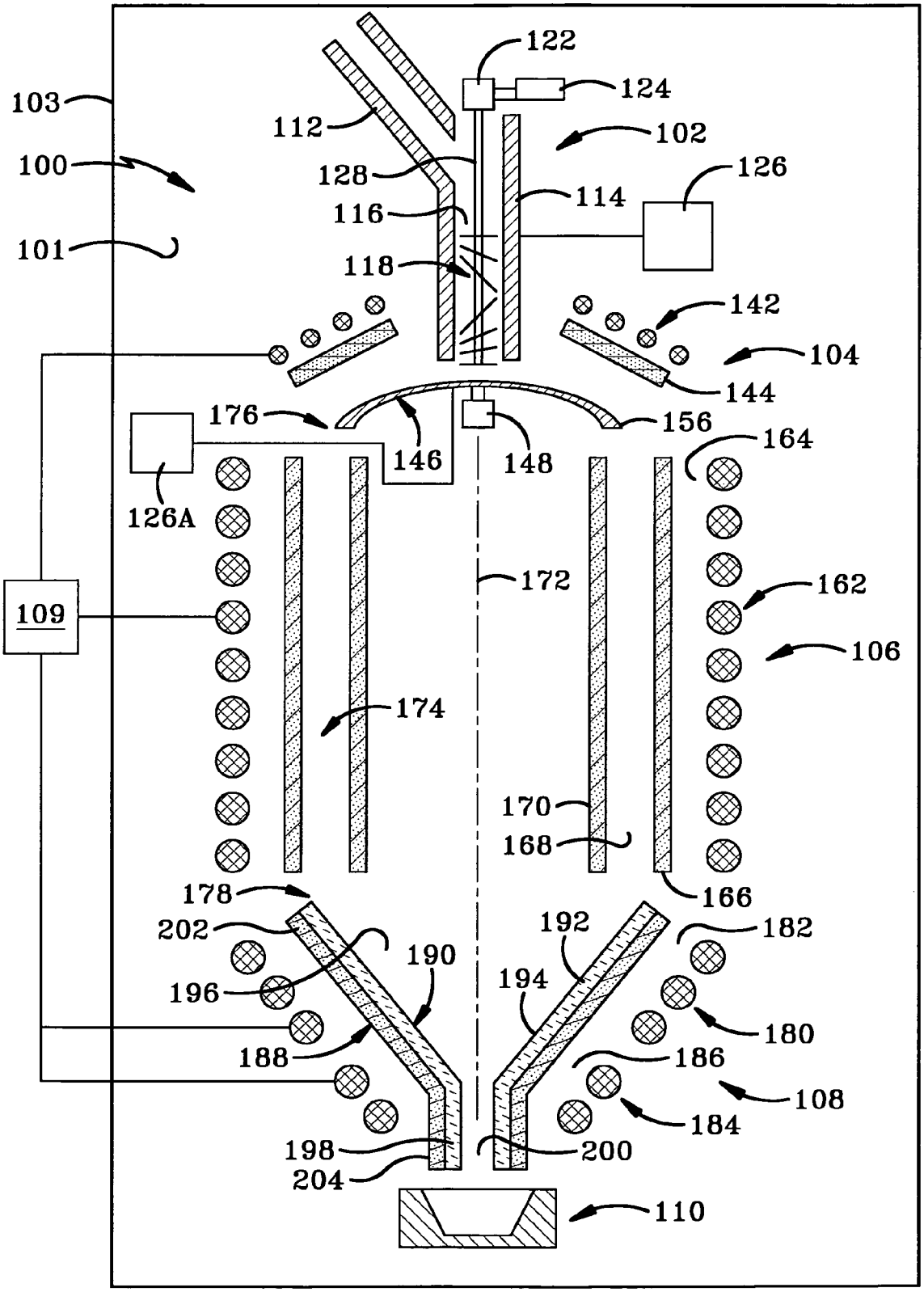
FIG. 1 is a sectional view of the first embodiment of the induction furnace of the present invention with an empty first mold therebelow.

The induction furnace of the present invention is indicated generally at 100 and is shown in FIG. 1. Furnace 100 includes a feed mechanism 102, a preheating assembly 104, a free fall radiative heating assembly 106 and a collector assembly 108 all typically within an interior chamber 101 enclosed by a melting chamber wall 103. Depending on the specific circumstances, interior chamber 101 may be under vacuum or may be filled with air or another gas which may or may not be inert. Furnace 100 is configured to melt particulate material and transfer the material in molten form into a receiving container such as a tundish or a mold 110. Furnace 100 includes an electrical power source 109.

Figure 2:
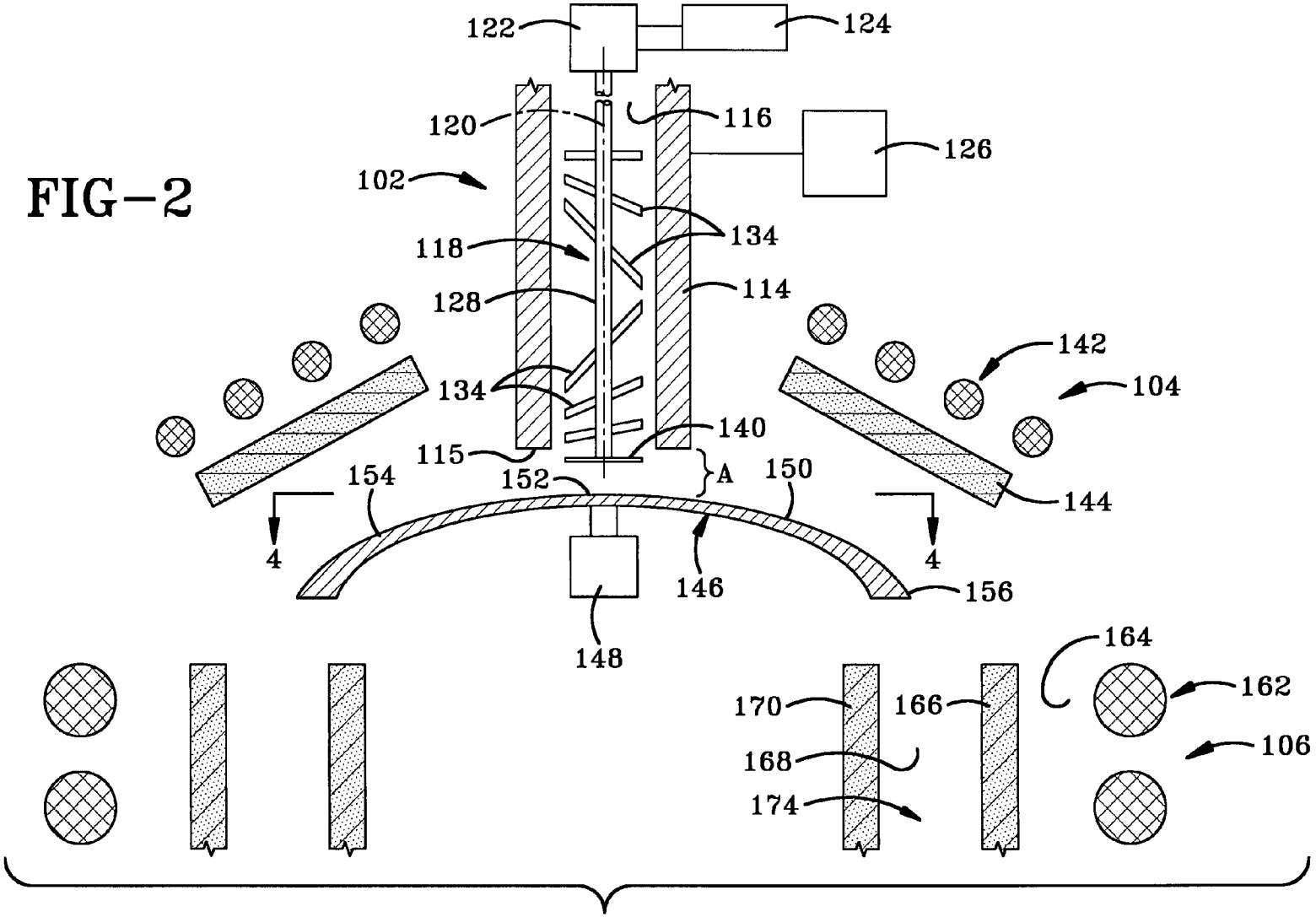
FIG. 2 is an enlarged fragmentary sectional view of the first embodiment showing the feed mechanism and the dispersion plate of the preheating section.

Feed mechanism 102 (FIGS. 1-3) is configured to feed particulate material from a feed tube 112 onto preheating assembly 104, as further detailed below. Feed mechanism 102 includes a vertical tube 114 having a lower end 115 and defining an interior feed chamber or particle passage 116 for housing a rotatable member 118 which is rotatable about a vertical axis 120 (FIG. 2). Feed mechanism 102 further includes a motorized drive 122 from which rotatable member 118 extends downwardly and a gas supply source 124 in communication with rotatable member 118. Source 124 includes a gas propulsion device such as, for instance, a blower, pump or a gas compressor with a control valve for controlling the flow of gas therefrom. A lift 126 is operatively connected to tube 114 for raising and lower tube 114.

Figure 3:
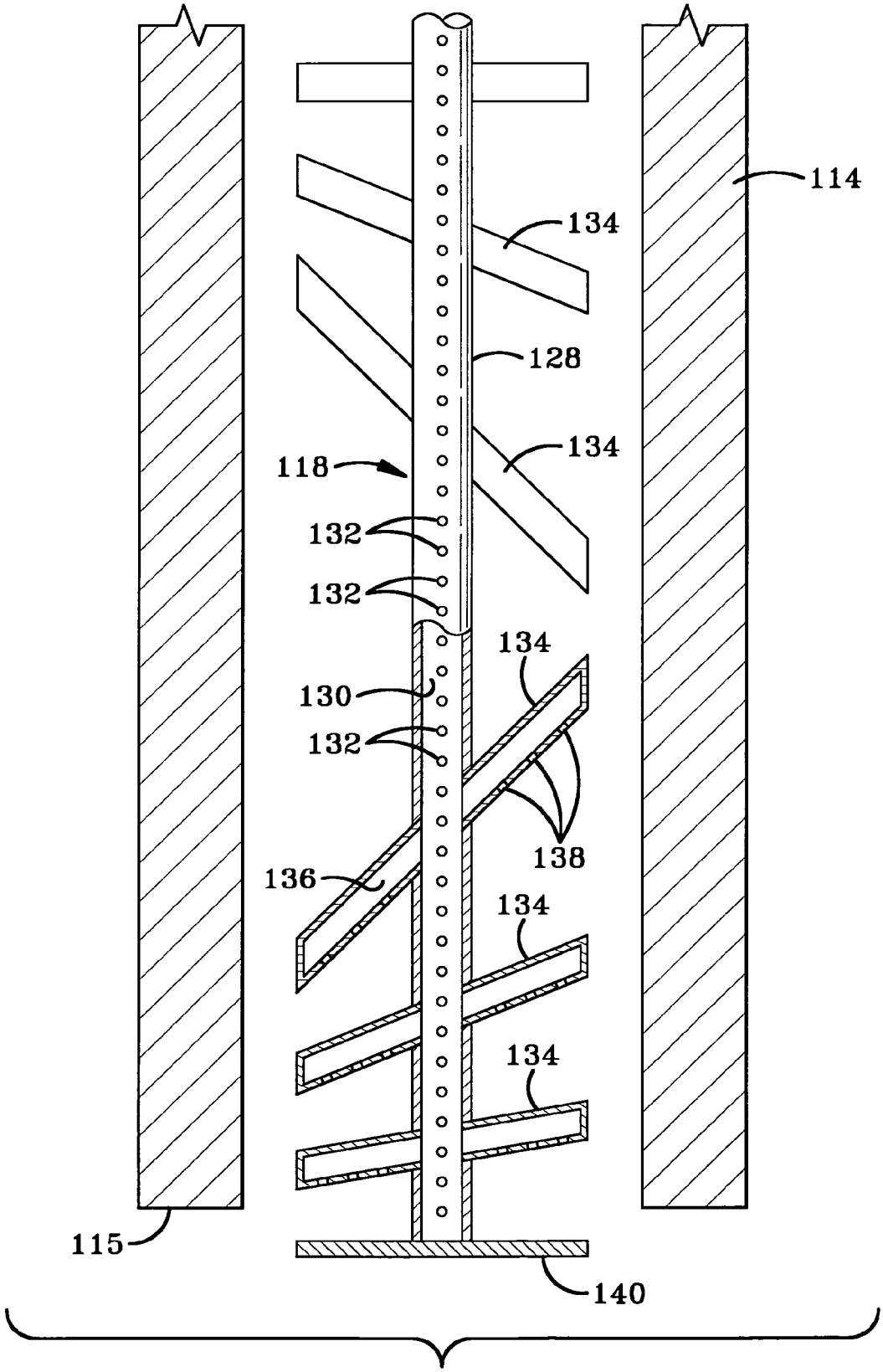
FIG. 3 is an enlarged fragmentary view with portions cut away of the feed mechanism of the first embodiment.

In accordance with one of the main features of the present invention, and with reference to FIG. 3, rotatable member 118 includes a vertically oriented shaft 128 defining an interior passage 130 extending over the entire length of shaft 128 and further defining a plurality of through holes 132 in communication with passage 130 and interior chamber 116. Rotatable member 118 further includes a plurality of fingers 134 each defining an interior passage 136 and a plurality of through holes 138 in communication with passage 136 and interior chamber 116. Fingers 134 extend outwardly from shaft 128 at varying angles. A terminal finger 140 is connected at a lower end of shaft 128 and extends radially outwardly from axis 120.

Figure 4:
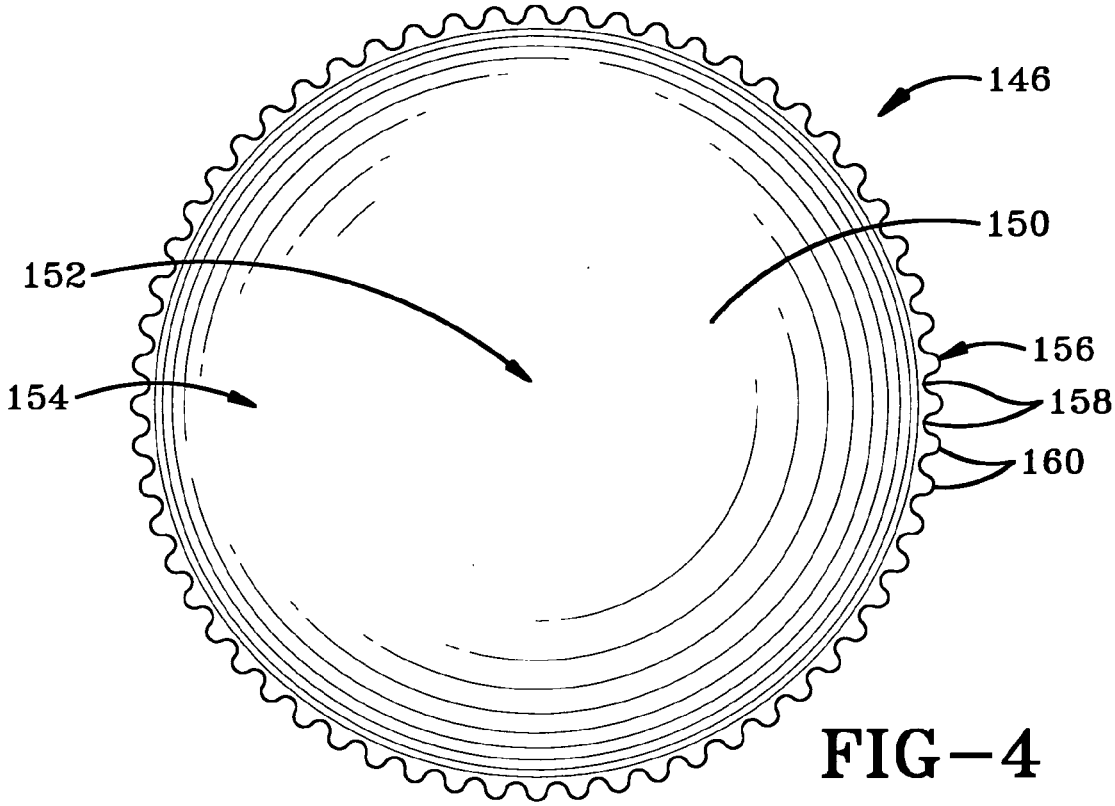
FIG. 4 is a top plan view of the dispersion plate taken on line 4-4 of FIG. 2.

In accordance with another feature of the invention, preheating assembly 104 is described (FIGS. 1, 2, and 4). Assembly 104 includes an electromagnetic induction member in the form of an induction coil 142, a susceptor 144, a dispersion member in the form of a dispersion plate 146 and a vibrating mechanism 148 for vibrating plate 146. Lift 126A may also be operatively connected to plate 146 to raise and lower plate 146. Induction coil 142 is in electrical communication with power source 109. Induction coil 142 is generally frustoconical and tapers radially downwardly and outwardly with respect to axis 120. Susceptor 144 is also frustoconical and positioned below induction coil 142 so that the frustoconical shape of coil 142 and susceptor 144 are generally aligned. Dispersion plate 146 has a convex upper surface 150 having a central portion 152 disposed below feed mechanism 102 and an outer portion 154 extending radially outward from portion 152 and disposed generally below and facing toward susceptor 144. Outer portion 154 has a curved surface which curves outwardly and downwardly so that it is generally aligned with susceptor 144. Dispersion plate 146 has a substantially circular outer perimeter or periphery 156 which is serrated or includes a plurality of recesses 158 extending radially inwardly and a plurality of ridges 168 extending radially outwardly and alternating with respective recesses 158 (FIG. 4). Upper surface 150 of dispersion plate 146 and lower end 115 of vertical tube 114 define therebetween a vertical space A (FIG. 2) which is adjustable by the raising or lowering of tube 114 by lift 126 or of plate 146 by lift 126A.

In accordance with another feature of the invention, heating assembly 106 is described (FIG. 1). Heating assembly 106 includes an electromagnetic induction member in the form of a substantially cylindrical induction coil 162 defining a generally cylindrical interior space 164. Induction coil 162 is in electrical communication with power source 109. Assembly 106 further includes an outer substantially cylindrical susceptor 166 disposed in interior space 164 of induction coil 162. Susceptor 166 defines a substantially cylindrical interior space 168 in which is disposed a substantially cylindrical thermal reflector which in the exemplary embodiment is an inner susceptor 170. Induction coil 162, outer susceptor 166 and inner susceptor 170 are typically all substantially concentric about a central vertical axis 172. Outer susceptor 166 and inner susceptor 170 define therebetween an annular free fall zone 174 which is a substantially cylindrical through passage which opens upwardly at the top of susceptors 166 and 170 and downwardly at the bottom of susceptors 166 and 170. Periphery 156 of dispersion plate 146 defines an upper boundary 176 of free fall zone 174. Periphery 156 extends radially outwardly of inner susceptor 170 and is disposed radially inwardly of outer susceptor 166. Free fall zone 174 has a lower boundary 178 within collector assembly 108, as further detailed below.

In accordance with another feature of the invention, collector assembly 108 is described (FIG. 1). Assembly 108 includes an upper collector electromagnetic induction member in the form of a generally frustoconical induction coil 180 defining a generally frustoconical interior space 182. Assembly 108 further includes a lower collector or nozzle electromagnetic induction member in the form of a generally frustoconical induction coil 184 defining a generally frustoconical interior space 186. Induction coils 180 and 184 are each in electrical communication with power source 109. Upper coil 180 and lower coil 184 each taper radially inwardly and downwardly with respect to axis 172 with susceptor 188 circumscribing funnel 190. Assembly 108 further includes a funnel-shaped susceptor 188 disposed partially within spaces 182 and 186. Assembly 108 further includes a funneling member in the form of a funnel 190 disposed inwardly of and in contact with susceptor 188. Susceptor 188 and funnel 190 are substantially radially symmetrical about axis 172 with susceptor 188 circumscribing funnel 190. Funnel 190 includes an inclined section in the form of a frustoconical collecting portion 192 having an inner surface 194 defining a frustoconical cavity 196. Lower boundary 178 of free fall zone 174 lies on inner surface 194 of funnel 190.

Funnel 190 further includes a substantially cylindrical nozzle 198 extending downwardly from collection portion 192 and defining an exit channel in the form of a through passage 200 communicating with and extending downwardly from cavity 196. Susceptor 188 includes a generally frustoconical collector portion 202 associated with and in contact with the outer surface of collecting portion 192 of funnel 190. Susceptor 188 further includes a substantially cylindrical nozzle portion 204 extending downwardly from collector portion 202 and in abutment with the outer surface of nozzle 198.

As known in the art, susceptors are formed of an electrically conductive material which is thus susceptible to inductive heating via the electromagnetic field produced by an induction coil or other induction member. Each of susceptors 144, 166, 170 and 188 thus is formed of an electrically conductive material, most typically carbon or graphite. As previously noted, dispersion member 146 may also serve as a susceptor and thus is formed of an electrically conductive material. This is also be true of funnel 190 when it is used as a susceptor.

Figure 5:
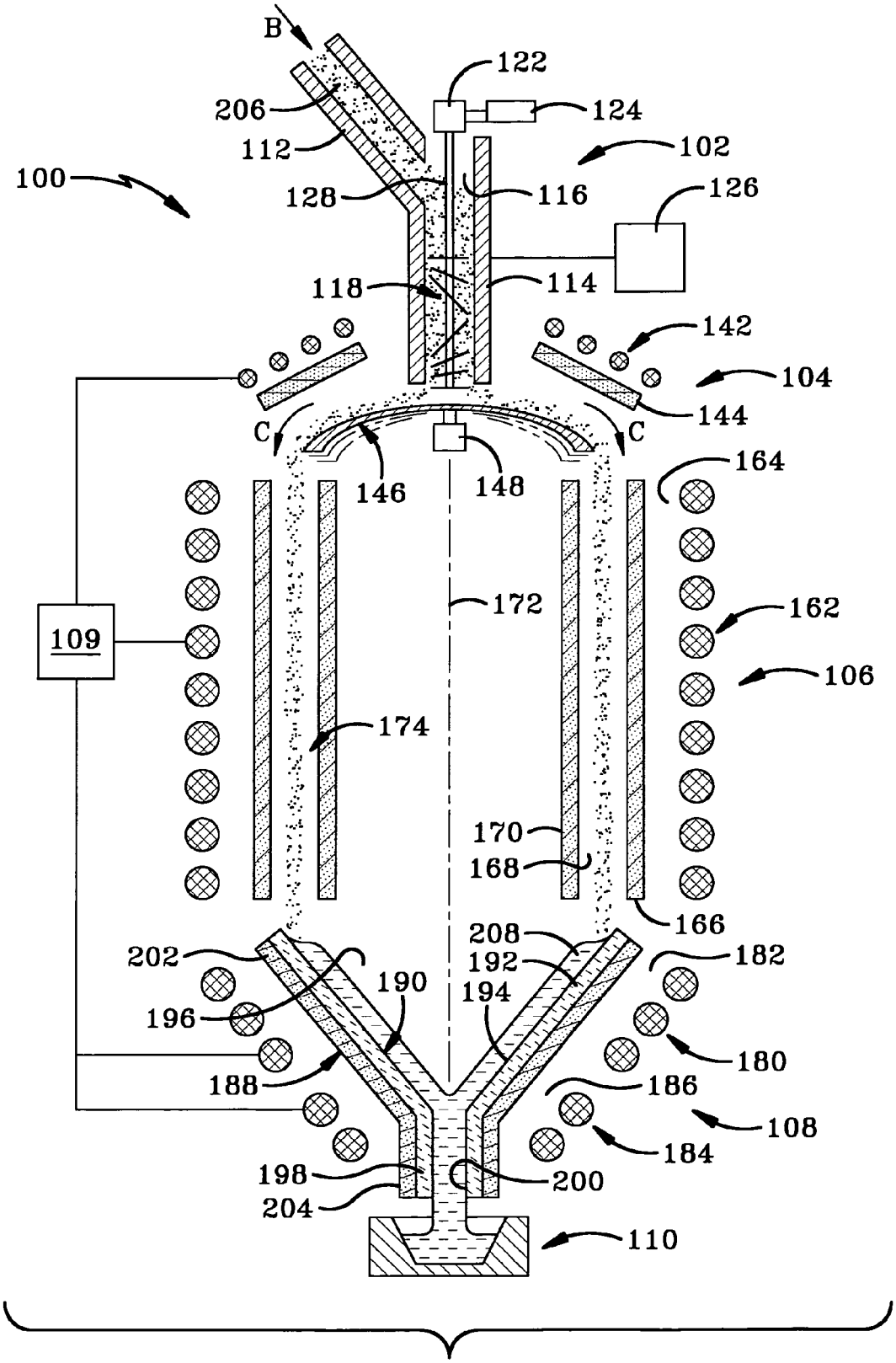
FIG. 5 is similar to FIG. 1 and shows the induction furnace in operation with particulate material being fed into and melted by the furnace.

In accordance with several features of the invention and with reference to FIG. 5, the overall operation of furnace 100 is described. Detailed description of the several features is provided further below. Induction coils 142, 162, 180, and 184 are electrically powered by source 109 to create respective electromagnetic fields in which the susceptors are disposed. Source 109 includes a control unit for selectively and independently controlling the amount and frequency of electrical energy provided to each of said induction coils. Induction coil 142 thus electromagnetically couples with susceptor 144 to inductively heat susceptor 144, which in turn creates radiation heat. Induction coil 142 also couples with dispersion plate 146 to inductively heat dispersion plate 146, which in turn creates radiation heat. Induction coil 162 similarly couples with and inductively heats each of susceptors 166 and 170, each of which also create radiation heat in the atmosphere surrounding them. Susceptors 166 and 170 serve as thermal reflectors which reflect the radiated heat from one another back into free fall zone 174, thus additionally increasing the heating efficiency therein. This is true even when one of the susceptors 166 and 170 is not formed of a material susceptible to inductive heating (and thus not serving as a susceptor). Induction coils 180 and 184 also couple with susceptor 188 to inductively heat susceptor 188, which transfers heat to funnel 190 via conduction and radiation.

Particulate material 206 primarily in powder or granular form is fed into feed tube 112 and moves from feed tube 112 into vertical tube 114. Particulate matter 206 travels through interior chamber 116 of vertical tube 114 and falls onto the upwardly facing surface of dispersion plate 146, over which material 206 is dispersed radially outwardly toward periphery 156 from adjacent center portion 152 (FIG. 2). This radial dispersion or spreading of material 206 substantially increases the space or distance between the particles. The impact of material 206 falling from tube 114 onto dispersion plate 146 helps to break up remaining clumps of material 206. Particulate material 206 is heated to a temperature below its melting point by the radiating heat from susceptor 144 and by radiative and conductive heat from dispersion plate 146 as it travels over dispersion plate 146. Particulate material 206 then falls over periphery 156 of dispersion plate 146 as indicated by Arrows C in FIG. 5 into free fall zone 174 between susceptors 166 and 170, forming an annular and typically cylindrical curtain of free falling solid particulate material extending vertically downwardly from periphery 156.

According to one feature of the invention, particulate material 206 is heated during free fall by the radiation heat coming from susceptors 166 and 170 so that by the time particulate material 206 reaches lower boundary 178 of free fall zone 174, some or all of particulate material 206 is melted, as indicated by molten portion 208. The melting of solid particulate material 206 during free fall may thus produce an annular curtain of molten or semi-molten free falling droplets within free fall zone 174. Molten portion 208 flows along inner surface 194 of funnel 190 toward nozzle 198. Any of material 206 which is not molten by the time it reaches funnel 190 is then melted by conductive and radiative heat coming from susceptor 188 via funnel 190 so that by the time material 206 reaches nozzle 198, all of it is typically in a molten state. Molten material 208 then flows through passage 200 of nozzle 198 and into mold 110.

Figure 6:
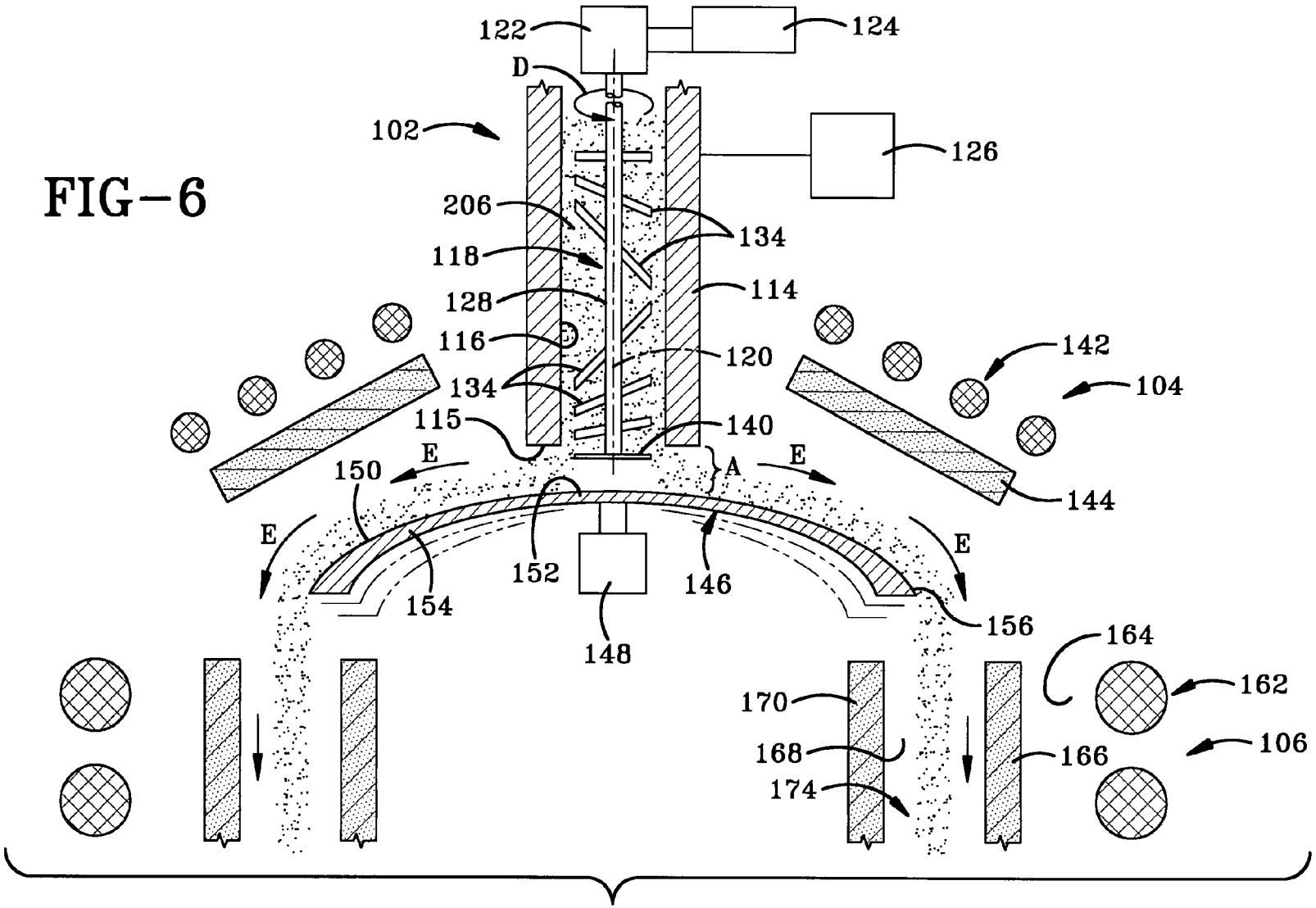
FIG. 6 is an enlarged fragmentary view of the feed mechanism and preheat section of the first embodiment shown in operation.

In accordance with one of the features of the invention, the operation of feed mechanism 102 is further detailed (FIGS. 2, 3, 5 and 6). As shown in FIG. 6, drive 122 rotates rotatable member 118 about vertical axis 120 as indicated by Arrow D to help break apart any clumping particulate matter 206, which is achieved in part by the rotational movement of fingers 134. The breaking up and dispersion of particulate matter 206 within feed chamber 116 is aided by holes 132 in shaft 128 and holes 132 in fingers 134. More particularly, gas supply source 124 is operated to provide a flow of appropriate gas (usually an inert gas such as argon) which flows through passage 130 of shaft 128 and through holes 132 as well as into passages 136 of fingers 134 and through holes 138. For example, the gas may be blown, pumped or released from compression via a valve to provide the gas flow. Thus, gas flowing through holes 132 and 138 into feed chamber 116 helps to disperse and break up particulate matter 206. If sufficient gas flow is provided, a fluidized bed of powder is produced which facilitates the flow of particulate material 206 through vertical tube 114 and onto dispersion plate 146. The ability to pump gas through passages 130 and 136 and holes 132 and 138 also serves to eliminate often unwanted gases such as oxygen and nitrogen trapped within particulate material 206 to prevent unwanted chemical reactions during the heating and melting process such as oxidation.

Another feature of the invention is further detailed regarding preheating assembly 104 (FIGS. 5-6). Preheating assembly 104 is configured to heat particulate material 206 as it moves across dispersion plate 146 and also to disperse material 206 into a layer which is sufficiently thin to be effectively heated and preferably melted in free fall zone 174. As previously noted, induction coil 142 inductively heats susceptor 144, which transfers heat by radiation to particulate material 206 as it passes over dispersion plate 146. Induction coil 142 also inductively heats plate 146, which transfers heat to particulate material 206 via radiation and conduction as material 206 moves over plate 146. The preheating of material 206 serves to reduce the height of the free fall zone 174 required to melt material 206 and thus helps minimize the size of furnace 100. The heating of material 206 as it passes over dispersion plate 146 is efficient due in part to high surface exposure of the particles to radiative heat and is effective because the heating is occurring just prior to and during transition to free fall zone 174. However, material 206 may be preheated within feed mechanism 102 if desired, alternatively or in combination with preheat assembly 104.

To facilitate dispersion of particulate material 206 falling from feed mechanism 102, vibrating mechanism 148 is operated to vibrate dispersion plate 146, as indicated by the phantom lines in FIGS. 5 and 6, so that particulate material 206 travels along the upper surface of plate 146 radially outwardly from axis 120 toward and over periphery 156 of dispersion plate 146 and downwardly into free fall zone 174, as indicated by Arrows E in FIG. 6. The velocity of travel of particulate material 206 along dispersion plate 146 is generally a function of the amplitude and frequency of vibration and the curvature of dispersion plate 146. The amount of material 206 moving along plate 146 and over periphery 156 is also a function of the height of gap A, which is vertically adjustable, as detailed further below.

Another feature of the invention relates to serrated periphery 156 of dispersion plate 146. Recesses 158 and ridges 160 create a greater overall length of periphery 156 in comparison to a smooth circular periphery of a dispersion plate having a similar diameter. Thus, serrated periphery 156 increases dispersion of material 206 without increasing the diameter of the dispersion plate, thereby providing greater exposure of the particles of material 206 to radiative heat during free fall in zone 174. This allows dispersion plate 146 to be more effective while maintaining a smaller induction furnace without sacrificing melting capability.

By the time particulate material 206 reaches periphery 156 of dispersion plate 146, material 206 is sufficiently broken apart and dispersed to form the previously mentioned annular or cylindrical veil or curtain of particulate material freely falling from dispersion plate 146 through free fall zone 174. During the free fall of particulate material 206, sufficient radiative heat is absorbed by material 206 from susceptors 166 and 170 to melt some or all of material 206. If material 206 is completely molten by the time it reaches lower boundary 178 of free fall zone 174, heated funnel 190 serves to maintain the material in a molten state as indicated at 208 and to direct material 208 as it flows downwardly along inner surface 194 toward and through passage 200 of nozzle 198. If on the other hand, material 206 is not completely molten by the time it reaches funnel 190, then funnel 190 is sufficiently heated via inductive coils 180 and 184 and susceptor 188 to melt any remaining solid material 206 prior to passing through passage 200 and into mold 110. Molten material exiting nozzle 198 may also undergo further processing, such as producing shot, without entering a mold.

Figure 7:
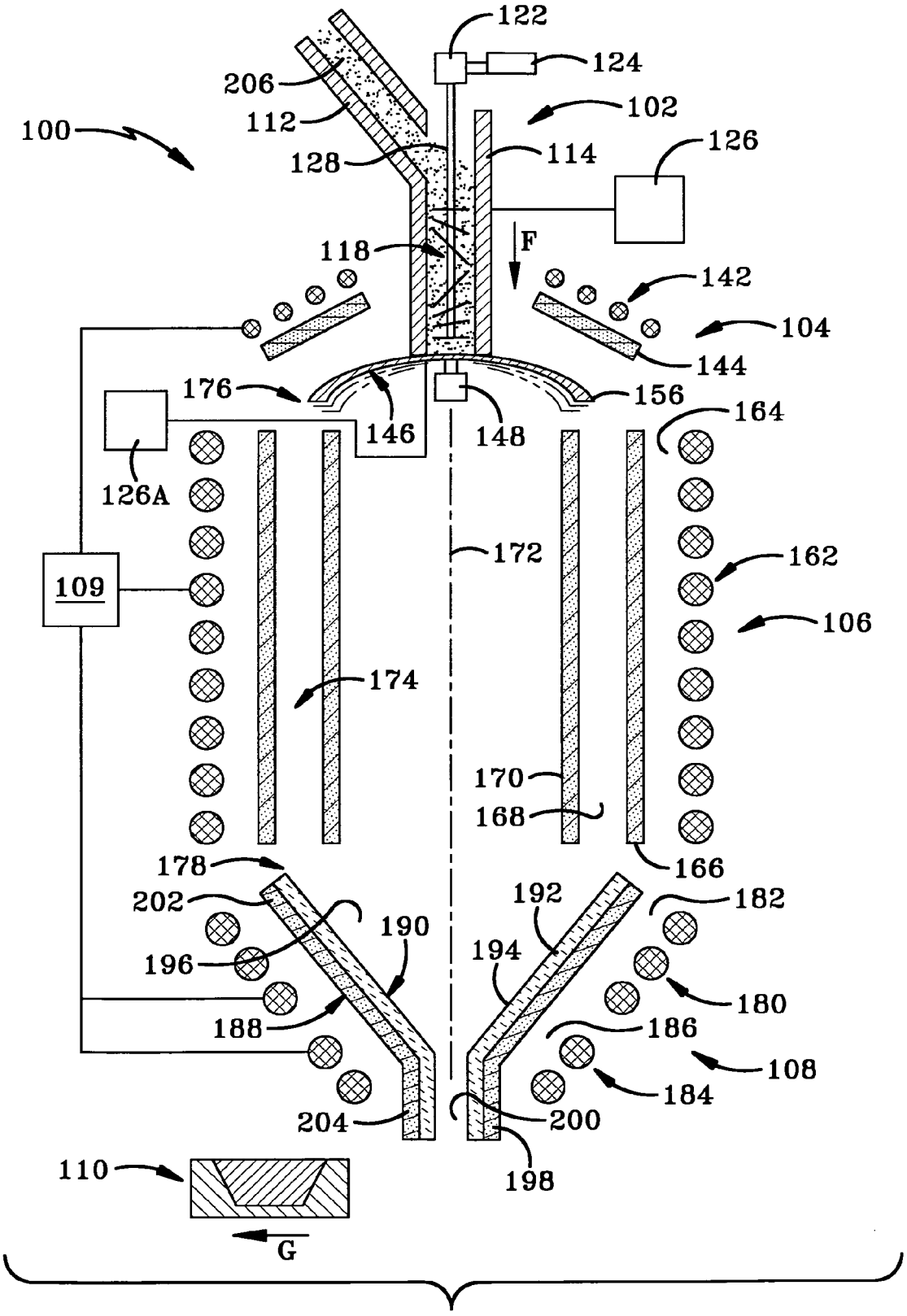
FIG. 7 is similar to FIG. 5 and shows the feed mechanism moved downwardly to stop the flow of particulate material through the furnace and the removal of the first mold after being filled.
Figure 8:
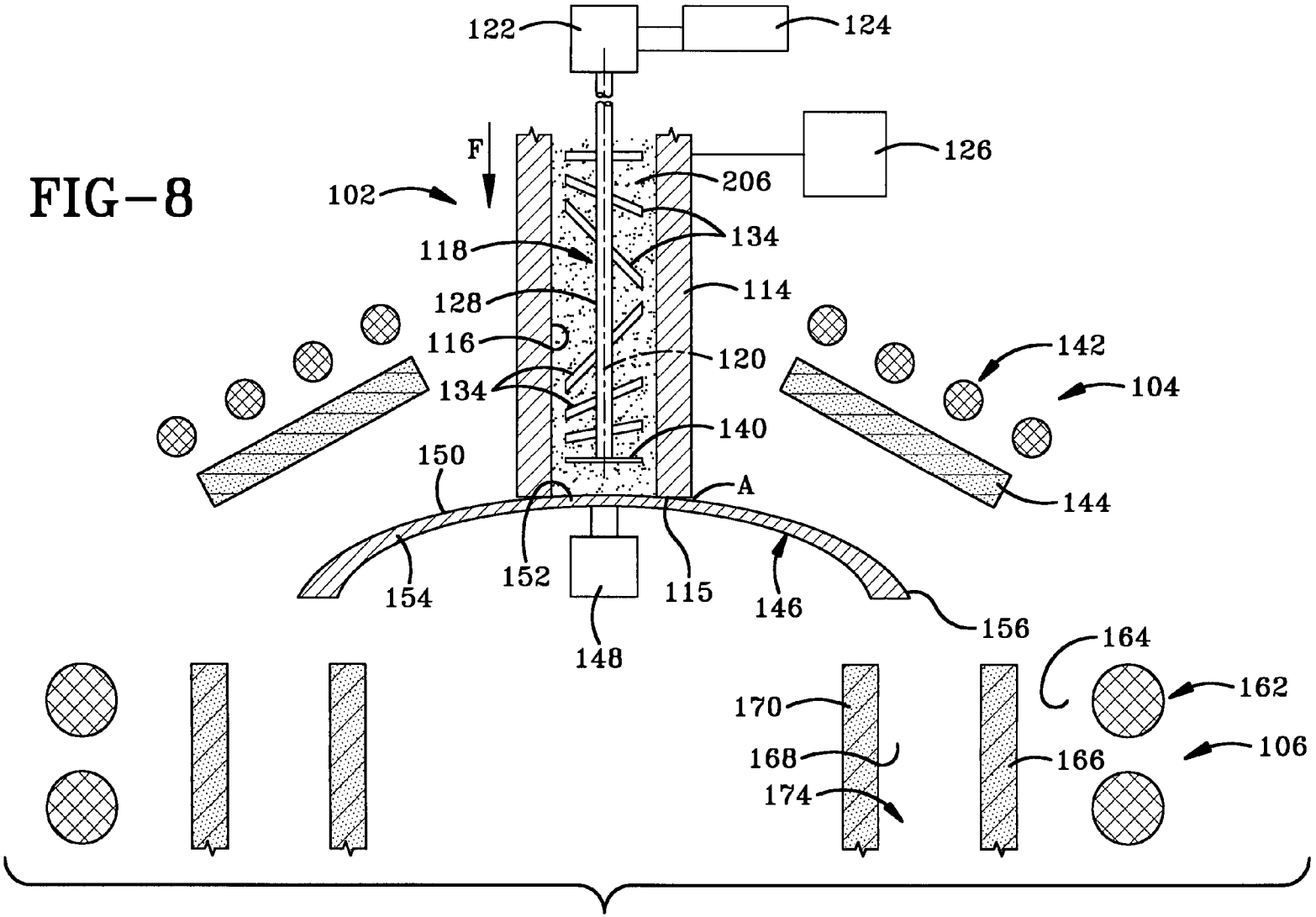
FIG. 8 is an enlarged fragmentary sectional view of the feed mechanism and preheat section showing the feed mechanism having been lowered to stop the flow of material.
Figure 9:
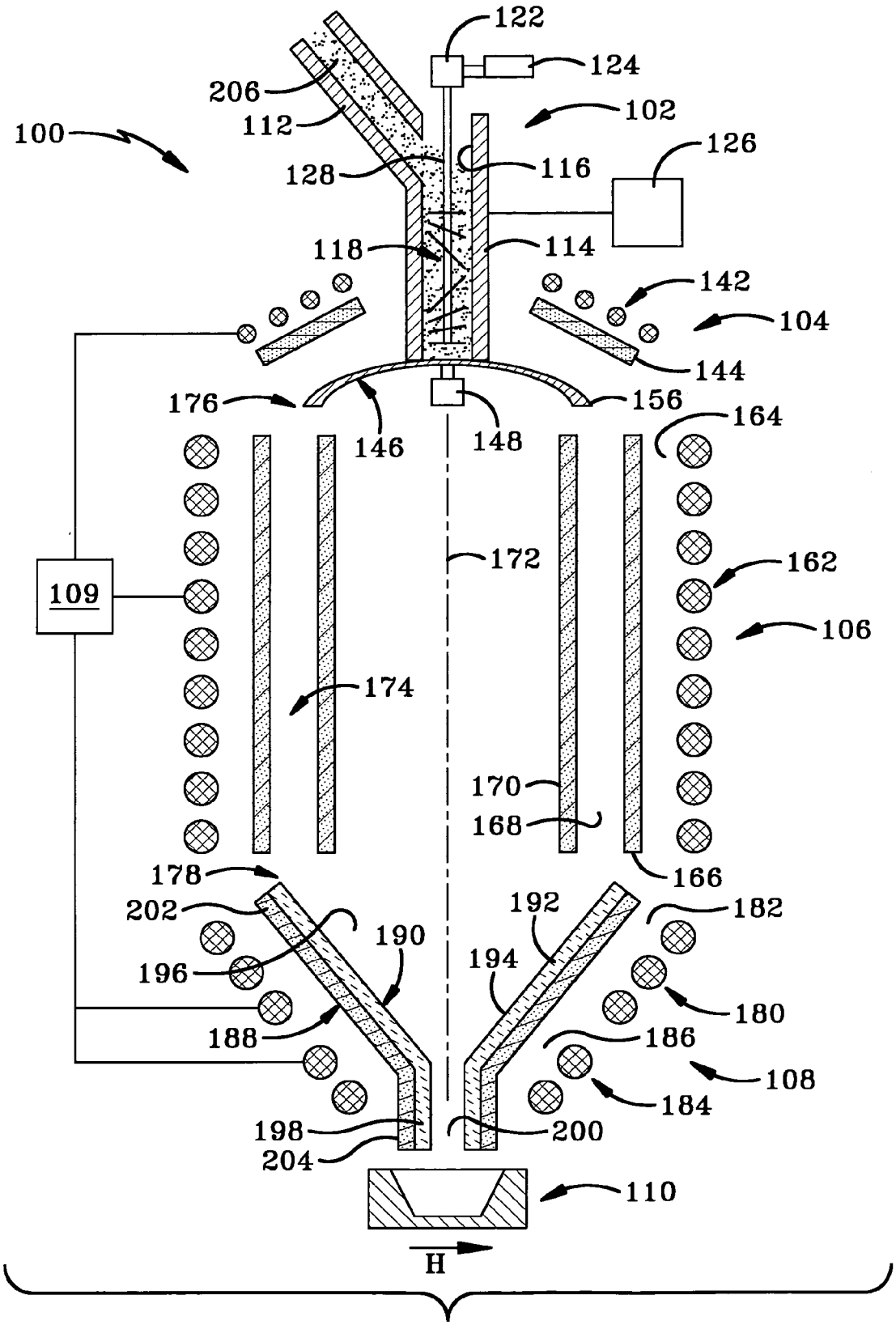
FIG. 9 is similar to FIG. 7 and shows the feed mechanism in the lowered position and an empty second mold being moved into position below the funnel.
Figure 10:
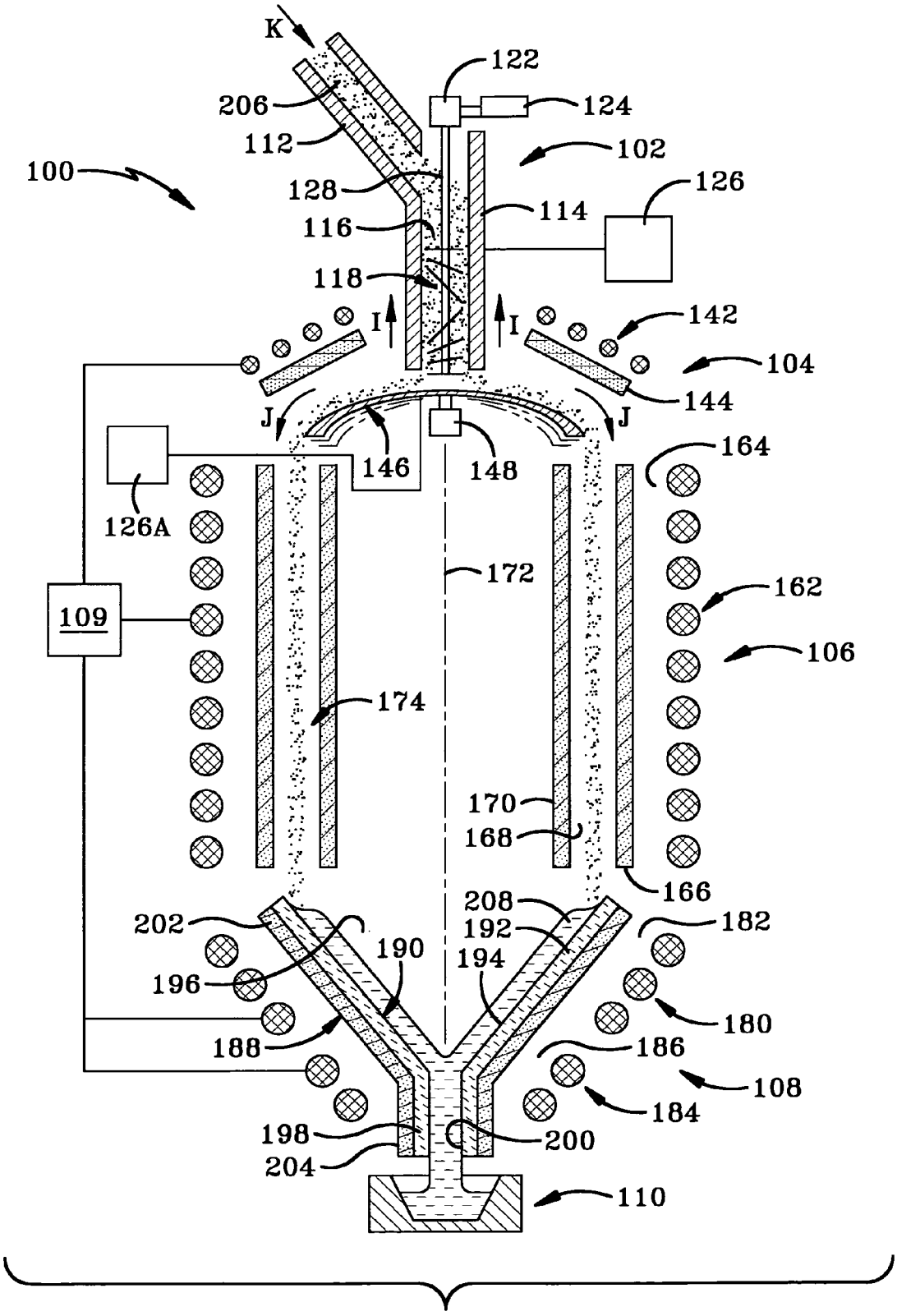
FIG. 10 is similar to FIG. 9 and shows the feed mechanism moved upwardly to allow the flow and melting of the particulate material and the pouring of the particulate material into the second mold.

Another feature of the invention is the ability to easily stop and start the melting process at any time during operation (FIGS. 6-10). To that effect, lift 126 or 126A is operated to adjust the height of gap A, by raising or lowering tube 114 or dispersion plate 146 relative to the other, as previously noted. The opening or closing of gap A regulates the volume of material available to be vibrated across dispersion plate 146. FIG. 6 shows material 206 falling from feed mechanism 102 onto dispersion plate 146 and into free fall zone 174 whereby material 206 is heated and ultimately melted. FIG. 7 shows vertical tube 114 having been moved downwardly as shown by Arrows F by operation of lift 126 so that lower end 115 of vertical tube 114 is closely adjacent or abuts upper surface 150 of dispersion plate 146. Lift 126A may also be operated to raise plate 146 to this effect. Gap A is thus sufficiently minimized or, in the case of contact between tube 114 and dispersion plate 146, is eliminated (FIG. 8) so that particulate material 206 no longer flows from vertical tube 114 onto dispersion plate 146. As a result, the material 206 which had exited tube 114 onto dispersion plate 146 prior to the minimizing or closing of has fallen through free fall zone 174 and has been melted and passed through passage 200 of nozzle 198 into mold 110. Thus, the flow of particulate material 206 in solid and molten forms has ceased and mold 110 may be removed as shown by Arrow G in FIG. 7. During suspension of the flow of material 206 through furnace 100, a new mold 110 may be moved into place beneath nozzle 198 of funnel 190 as indicated by Arrow H in FIG. 9. Then, as shown in FIG. 10, lift 126 is operated to move vertical tube 114 upwardly as indicated by Arrows I (or lift 126A moves plate 146 downwardly) so that material 206 may flow out of tube 114 and onto and over dispersion plate 146 as indicated by Arrows J while new material is being added to feed tube 112 as indicated by Arrow K to provide continuous charging of material 206 into vertical tube 114. Thus, furnace 100 is restarted simply by sufficiently increasing gap A, whereupon the process repeats to preheat and melt material 206 and pour molten material 208 into new mold 110 (FIG. 10).

As previously noted, the travel velocity of material 206 over dispersion plate 146 is a function of the amplitude and frequency of the vibration of plate 146 as well as the curvature of upper surface 150 of plate 146. Thus, controlling these factors also provides control of the flow of particulate material 206 over plate 146. Upper surface 150 of plate 146 may be suitably configured so that when vibration plate 146 is stopped, material 206 will stop flowing as a result of the angle of repose of material 206 in combination with a sufficient adjustment of gap A. Thus, as previously noted, gap A does not need to be reduced to zero (FIG. 8) in order to stop the flow of particulate material 206 out of vertical tube 114 and across plate 146.

Another feature of the invention relates to heating assembly 106. As noted, the main feature of assembly 106 is to melt particulate material 206 during free fall. Assembly 106 may also be used to chemically react material 206 at elevated temperatures during free fall, particularly when material 206 is in a molten state during free fall. In particular, a desired gas may be introduced into free fall zone 174 to chemically react with material 206 during free fall, due to the elevated temperature of material 206 and the gas within zone 174.

Figure 11:
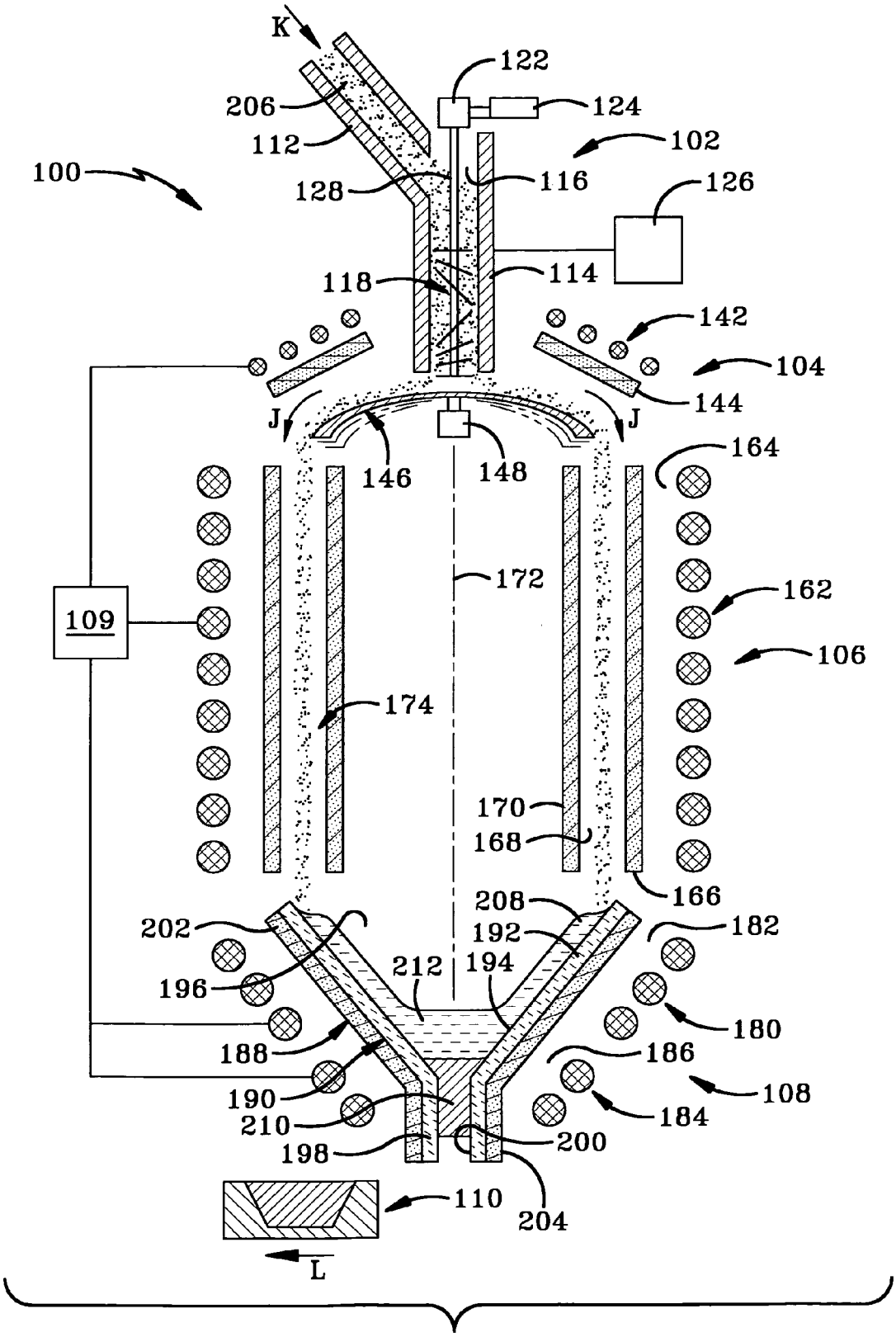
FIG. 11 is similar to FIG. 10 and shows a frozen plug of the material in the nozzle of the funnel to prevent flow of the molten material through the nozzle and shows the removal of the filled second mold.

Another feature of the invention is described regarding collector assembly 108 (FIG. 11). Collector assembly 108 is configured to selectively stop molten material 208 from flowing through passage 200 of nozzle 198. As previously noted, upper induction coil 180 and lowered nozzle induction coil 184 are powered by source 109 in order to inductively couple with susceptor 188 to inductively heat susceptor 188. In turn, susceptor 188 transfers heat by conduction and/or radiation to funnel 190 in order to maintain material 206 in a molten state 208 and to melt any material remaining in the solid state. The inductive heating of susceptor 188 may be accomplished by a single induction coil. However, nozzle induction coil 184 is positioned to control the temperature of susceptor 188 adjacent nozzle 198 and subsequently the temperature of nozzle 198 and the lower region of collecting portion 192 of funnel 190. Thus, the temperature in and around nozzle 198 may be independently lowered sufficiently to allow a frozen or solid plug 210 of material 206 to form within passage 200 of nozzle 198.

As a result, the flow of molten material 208 through passage 200 ceases and molten material begins to form a pool 212 in collecting portion 192. This provides a longer residence time of molten material within funnel 190 to provide more homogenous temperature and chemistry within pool 212. In addition, plug 210 may be maintained long enough in order to remove mold 110 as indicated by Arrow L in FIG. 11 and be replaced with a subsequent mold as noted previously with reference to FIG. 9. Once a desired residence time has been allowed and/or a new mold has been positioned beneath nozzle 198, power to nozzle induction coil 184 is increased to raise the temperature of nozzle 198 to melt plug 210 and allow the flow of molten material 208 from pool 212 to flow into mold 110.

Figure 13:
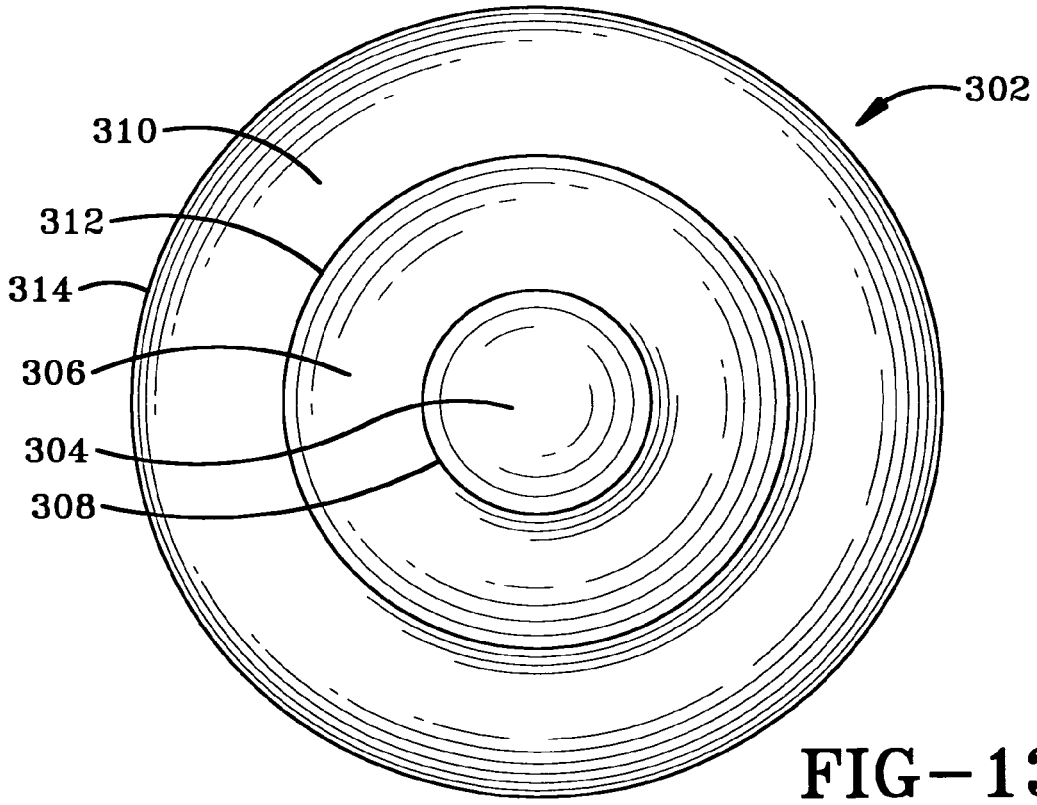
FIG. 13 is a top plan view of the dispersion plate of the second embodiment taken along line 13-13 of FIG. 12.
Figure 12:
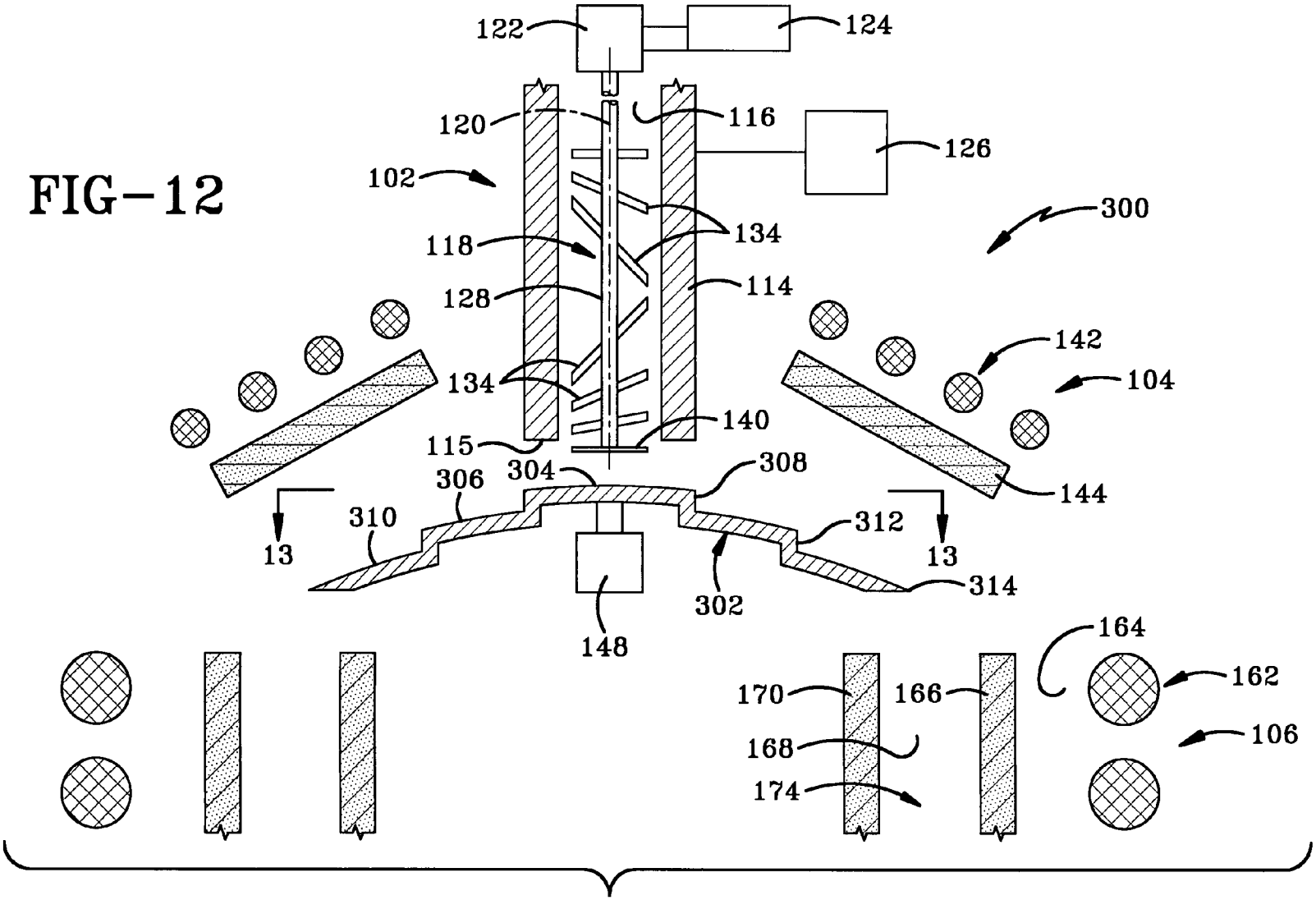
FIG. 12 is similar to FIG. 2 and shows a second embodiment of the present invention with a tiered dispersion plate.

Induction furnace 300 is now described with reference to FIGS. 12-13. Furnace 300 is similar to furnace 100 except furnace 300 includes a tiered or terraced dispersion plate 302.

Dispersion plate 302 includes a circular central tier 304 and an annular intermediate tier 306 with a vertical annular step 308 therebetween joining tiers 304 and 306. Plate 302 further includes an annular outer tier 310 joined to intermediate tier 306 by a vertical annular step 312. Plate 302 has a smooth circular periphery 314 although it may be serrated like that of member 146.

In operation, furnace 300 works in the same manner as furnace 100 except with regard to dispersion plate 302. Particulate material 206 falls from vertical tube 114 onto central tier 304 and is dispersed radially outwardly over step 308 onto tier 306 and then over step 312 onto outer tier 310 before falling over periphery 314 into free fall zone 174. Steps 308 and 312 provide areas where particulate material 206 falls respectively from central tier 304 onto intermediate tier 306 and from intermediate tier 306 onto outer tier 310. The falling over steps 308 and 312 allows material 206 to attain a sufficient velocity whereby impact on respective tiers 306 and 310 facilitates the breaking up of particulate material 206. This breaking up and dispersion of particulate material 206 aids in the preheating of material 206 while traveling along the upper surface of dispersion plate 302 as well as the heating and melting of material 206 as it moves through free fall zone 174, due to increased surface area exposure of material 206.

Thus, induction furnaces 100 and 300 provide relatively small structures which efficiently melt particulate material and resolve several problems in the prior art, as discussed in the background of this application. A variety of changes may be made to furnaces 100 and 300 which are within the scope of the present invention, as will be appreciated by those skilled in the art. For example, rotatable member 118 may be replaced by a worm gear, a helical-type mixer or other mechanism suitable for mixing and facilitating the breakup of particulate material 206. In addition, a rotatable member similar to rotatable member 118 may be used which has a solid shaft and solid fingers, thus eliminating the use of air passages and holes. Such a shaft and fingers still facilitate the breaking up and dispersion of particulate material 206 passing through tube 114. Where the furnaces are to be operated in a vacuum setting, the passages and holes in the shaft and fingers would not be used in any case. One advantage of using furnace 100 or 300 in a vacuum environment is the elimination of gas currents which may cause particulate material 206 to be blown off course particularly during free fall within free fall zone 174.

In addition, a rotatable member such as member 118 may incorporate holes such as holes 132 in shaft 128 without holes 138 in fingers 134 or vice versa. Holes 138 and fingers 134 are only shown on the lower portion of fingers 134 but may be in any suitable position. Fingers 134 may be at various angles with respect to vertical axis 120 (as shown in FIG. 3) and may also be straight, curved or bent as desired.

Dispersion members such as plates 146 and 302 may have a variety of shapes and need not be in the form of a plate. Preferably, the dispersion plate has an outer periphery which is generally circular and is also serrated or includes some type of recesses and ridges. However, a dispersion plate could have a periphery as viewed from above which is triangular, square, oval or any other suitable shape. The upper surface of the dispersion plate may also vary. Typically, the dispersion plate upper surface tapers downwardly and outwardly from a central vertical axis and is radially symmetrical about said axis. However, a dispersion plate could be simply angled so that particulate material 206 disperses laterally generally in one direction as opposed to being radially dispersed. However, this is not as efficient as dispersion in a 360° radius. The curvature of the upper surface may also vary, and while the dispersion plate shown in the drawings have a relatively gradual curvature, they may be tapered much more sharply depending on the material which is being fed from the feed mechanism onto the dispersion plate. While the dispersion plate is preferably vibratable, it may also be stationary and have an upper surface configured so that particulate material 206 will flow over the dispersion plate without the need to be vibrated. Such a dispersion plate may be chosen for a particular material or set of materials with regard to the angle of repose of a given material. In addition, the ridges and recesses of the periphery of the dispersion plate may vary in shape.

The susceptors and induction coil used in the free fall heating assembly may have various shapes and thus need not be cylindrical nor define an interior space. The dispersion plate periphery or edge over which the particulate material falls and the heat assembly susceptors should have shapes so that the curtain or veil of particulate material freely falls sufficiently close to the susceptors for efficient absorption of heat radiating therefrom. In addition, the heating assembly may include a single susceptor although a pair of susceptors on either side of the free fall zone substantially increases the heating capability.

The heating of particulate material 206 as it falls through heating assembly 106 is most effective when used with particles of material 206 which are of the same size and which are completely dispersed and broken up so that the surface area of each particle falling within free fall zone 174 is nearly the same. This is helpful in being able to appropriately power induction coil 162 to provide sufficient radiative heat from susceptors 166 and 170 to melt material 206 prior to reaching funnel 190. However, furnaces 100 and 300 are configured to work well even with particulate material having somewhat various sizes and/or which is not completely broken up as it falls through free fall zone 174. More particularly, as previously noted, collector assembly 108 is configured to provide sufficient heat via funnel 190 to melt any solid portions of material 206 which reach funnel 109. Thus, heated funnel 190 is particularly useful where heating assembly 106 is powered to melt particles only up to a given size during free fall whereby larger particles or clumps are not melted at the established power setting during free fall.

The heating of funnel 190 is accomplished by the use of susceptor 188 in conjunction with induction coils 180 and 184. However, susceptor 184 may be eliminated and funnel 190 itself may act as a susceptor which is directly inductively heatable by induction coils 180 and 184 to the same effect. Depending on the material to be melted, it may be preferred to use a funnel which is not inductively heatable and is formed of a material which will not react with or otherwise adversely affect the molten material as it flows along the funnel. In this case, a susceptor like susceptor 188 is needed where inductive heating is used in the process of heating the funnel.

In addition, the angle of the incline of the collecting portion of the funnel may be varied in order to control the rate of flow of molten material within the funnel. The angle of the collector portion incline controls residence time of molten material as it flows over the inner surface of the collector portion, which may be configured to provide for super heating of the molten material if desired.

The funnel, funnel-shaped susceptor and related induction coils of the collector assembly need not be radially symmetrical about axis 172. While the funnel would typically mimic the shapes of the susceptors in the heating assembly as well as the periphery of the dispersion plate, this is not a requirement. Instead of a traditional funnel-shape, the funnel may, for example, be an angled generally flat plate with upwardly extending walls which taper down to a spout, which does not necessarily include a through passage but may be upwardly open like spouts typically used to pour from tilting vessels. Thus, for instance, material falling from a cylindrical free fall zone may fall onto such a generally flat, inclined collector plate so that the spout or nozzle is offset from the central axis 172 and even laterally outward of the heating and preheating assemblies. Such a funneling member still allows the collection of molten material and allows it to flow through a spout or nozzle and into a mold or receiving crucible and the like. The funneling member may also incorporate a plurality of spouts or nozzles for use with a respective plurality of molds or other receiving vessels. Susceptors and induction coils related to alternate funneling members may be configured accordingly for highest efficiency.

In addition, collector assembly 108 may be eliminated whereby molten or partially molten material 206 may fall directly into a receiving vessel. If material 206 only is partially molten by the time it exits the free fall zone, it may fall into, for example, a molten bath which is sufficiently heated to melt any remaining solid material.

Furnace 100 and 300 have been described as having inductively heated susceptors. However, it is contemplated that other sources of heat may be used within the concept of the invention. For instance, susceptors 144, 166, 170 and 188 may also be resistance heating elements which emit radiation heat to heat material 206. Similarly, dispersion plate 146 and funnel 190 may be resistance heating elements. While inductive heating as described is more efficient and particularly useful for melting highly refractory materials, resistance heating, for example, may be useful in certain applications.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A furnace for use with particulate material, the furnace comprising:

a particle-feeding mechanism for feeding the particulate material;

a free fall heating zone below and in communication with the particle-feeding mechanism;

a free fall zone electromagnetic induction member;

a first susceptor adjacent the free fall zone and inductively heatable by the induction member whereby the first susceptor is positioned to transfer heat to the particulate material when the particulate material is freely falling in the free fall zone;

a thermal reflector bounding the free fall zone for reflecting heat radiated from the first susceptor;

a dispersion member having an upper surface above the free fall zone for dispersing the particulate material as it moves along the upper surface prior to entering the free fall zone;

a preheating electromagnetic induction member; and a preheating susceptor adjacent the dispersion member and inductively heatable by the preheating induction member whereby the preheating susceptor is positioned to transfer heat to the particulate material as it moves along the upper surface of the dispersion member.

2. The furnace of claim 1 wherein the free fall zone is between the first susceptor and the thermal reflector.

3. The furnace of claim 2 wherein the thermal reflector comprises a second susceptor inductively heatable by the induction member whereby the second susceptor is positioned to transfer heat to the particulate material when the particulate material is freely falling in the free fall zone; and the free fall zone is between the first and second susceptors.

4. The furnace of claim 3 wherein the first susceptor defines an interior chamber which includes the free fall zone; and the second susceptor is disposed within the interior chamber.

5. The furnace of claim 1 further comprising a particle passage formed in the feed mechanism through which the particulate material is movable; a shaft within the particle passage; a plurality of fingers secured to and extending outwardly from the shaft; and wherein the shaft and fingers are movable within the particle passage.

6. The furnace of claim 5 further comprising an interior shaft passage formed in the shaft; and a plurality of through holes formed in the shaft in communication with the shaft passage and the particle passage to allow gas flow from the shaft passage into the particle passage.

7. The furnace of claim 5 further comprising a shaft passage formed in the shaft; and a finger passage formed in one of the fingers in communication with the shaft passage and particle passage to allow gas flow from the shaft passage into the particle passage via the finger passage.

8. The furnace of claim 5 further comprising a finger passage formed in one of the fingers in communication with the particle passage to allow gas flow from the finger passage into the particle passage.

9. The furnace of claim 1 further comprising a particle passage formed in the feed mechanism through which the particulate material is movable; a shaft within the particle passage; a shaft passage formed in the shaft; and a plurality of through holes formed in the shaft in communication with the shaft passage and the particle passage.

10. The furnace of claim 9 further comprising a gas propulsion device in communication with the shaft passage.

11. The furnace of claim 1 further comprising a particle passage formed in the feed mechanism through which the particulate material is movable; a shaft within the particle passage; a plurality of fingers secured to and extending outwardly from the shaft; and a finger passage formed in one of the fingers in communication with the particle passage to allow gas flow into the particle passage.

12. The furnace of claim 1 wherein the upper surface of the dispersion member tapers radially outwardly and downwardly.

13. The furnace of claim 1 further comprising a vibrator operatively connected to the dispersion member so that the dispersion member vibrates in response to vibration of the vibrator.

14. The furnace of claim 1 wherein the preheating electromagnetic induction member is configured for inductively heating the dispersion member whereby the dispersion member is configured to transfer heat to the particulate material as it moves along the upper surface of the dispersion member.

15. The furnace of claim 1 further comprising a particle passage formed in the feed mechanism through which the particulate material is movable onto the upper surface of the dispersion member; and wherein the feed mechanism and dispersion member define therebetween a vertical space having a height; and one of the feed mechanism and dispersion member is vertically adjustable to change the height of the vertical space to provide a feed control for controlling the amount of the material moving along the upper surface of the dispersion member.

16. The furnace of claim 1 further comprising a heated funneling member comprising an inclined section below the free fall zone; and a channel formed in the funneling member lower than the inclined section; and wherein the funneling member is positioned to receive the material from the free fall zone and configured to direct the material in a molten state through the channel.

17. The furnace of claim 1, further comprising:

a heated funneling member positioned below the free fall zone to receive the particulate material from the free fall zone and configured to direct flow of the material in a molten state.

18. A furnace for use with particulate material, the furnace comprising:

a particle-feeding mechanism for feeding the particulate material;

a free fall heating zone below and in communication with the particle-feeding mechanism;

a free fall zone electromagnetic induction member;

a first susceptor adjacent the free fall zone and inductively heatable by the induction member whereby the first susceptor is positioned to transfer heat to the particulate material when the particulate material is freely falling in the free fall zone;

a thermal reflector bounding the free fall zone for reflecting heat radiated from the first susceptor;

a heated funneling member comprising an inclined section below the free fall zone;

a channel formed in the funneling member lower than the inclined section; wherein the funneling member is positioned to receive the material from the free fall zone and configured to direct the material in a molten state through the channel;

a first collector electromagnetic induction member; and a first collector susceptor adjacent the funneling member and inductively heatable by the first collector induction member whereby the collector susceptor is positioned to transfer heat to the funneling member.

19. The furnace of claim 18 wherein the funneling member channel is a through passage; the funneling member comprises a nozzle defining the through passage; and the first collector induction member is adjacent the nozzle for selectively heating the nozzle whereby the material in the through passage may be frozen and melted to control the flow of material through the nozzle.

20. A furnace for use with particulate material, the furnace comprising:

a particle-feeding mechanism for feeding the particulate material;

a free fall heating zone below and in communication with the particle-feeding mechanism;

a free fall zone electromagnetic induction member;

a first susceptor adjacent the free fall zone and inductively heatable by the induction member whereby the first susceptor is positioned to transfer heat to the particulate material when the particulate material is freely falling in the free fall zone;

a thermal reflector bounding the free fall zone for reflecting heat radiated from the first susceptor;

a funneling member which is below the free fall zone and comprises an inclined section having an inner surface positioned to receive the particulate material from the free fall zone and configured to direct flow of the material in a molten state;

a first collector electromagnetic induction member adjacent the funneling member and below the free fall zone electromagnetic induction member;

a first collector susceptor has a top;

the free fall zone has an upper boundary below the first susceptor; and the free fall zone has a lower boundary above the top of the first collector susceptor.

21. The furnace of claim 20 further comprising a dispersion member having an upper surface above the free fall zone for dispersing the particulate material as it move along the upper surface prior to entering the free fall zone.

22. The furnace of claim 21 further comprising a preheating electromagnetic induction member; and a preheating susceptor adjacent the dispersion member and inductively heatable by the preheating induction member whereby the preheating susceptor is positioned to transfer heat to the particulate material as it moves along the upper surface of the dispersion member.

23. The furnace of claim 20 wherein the first collector susceptor adjacent the funneling member and inductively heatable by the first collector induction member whereby the collector susceptor is positioned to transfer heat to the funneling member.

24. The furnace of claim 20 further comprising:

a dispersion member having a periphery which defines the upper boundary of the free fall zone.

* * * * *